US007327974B2

(12) United States Patent
Yaguchi et al.

(10) Patent No.: US 7,327,974 B2
(45) Date of Patent: Feb. 5, 2008

(54) ELECTROPHOTOGRAPHIC TONER AND IMAGE-FORMING SYSTEM

(75) Inventors: Shigenori Yaguchi, Ibaraki (JP); Ryuuichi Shimizu, Ibaraki (JP); Hiroshi Ueno, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 485 days.

(21) Appl. No.: 10/659,271

(22) Filed: Sep. 11, 2003

(65) Prior Publication Data

US 2004/0053153 A1 Mar. 18, 2004

(30) Foreign Application Priority Data

Sep. 12, 2002 (JP) ..... P.2002-267039

(51) Int. Cl.
*G03G 9/09* (2006.01)

(52) U.S. Cl. ..... 399/252; 399/343; 430/108.6

(58) Field of Classification Search ..... 430/106.1, 430/106.2, 108.6, 111.4; 399/252, 343
See application file for complete search history.

(56) References Cited

U.S. PATENT DOCUMENTS

| | | | | |
|---|---|---|---|---|
| 4,935,325 | A | 6/1990 | Kuribayashi et al. | |
| 5,155,000 | A * | 10/1992 | Matsumura et al. | 430/108.6 |
| 5,199,983 | A | 4/1993 | Katamoto | |
| 5,328,793 | A | 7/1994 | Misawa et al. | |
| 5,807,653 | A | 9/1998 | Nishihara et al. | |
| 6,130,017 | A * | 10/2000 | Hayashi et al. | 430/108.3 |
| 6,383,701 | B1 | 5/2002 | Tohata | |
| 6,534,230 | B1 * | 3/2003 | Blair et al. | 430/108.24 |
| 6,660,442 | B2 | 12/2003 | Sata et al. | |
| 6,677,093 | B2 * | 1/2004 | Yoshino et al. | 430/106.2 |
| 7,022,448 | B2 * | 4/2006 | Yaguchi et al. | 430/108.8 |
| 2004/0043317 | A1 * | 3/2004 | Yaguchi et al. | 430/108.8 |

FOREIGN PATENT DOCUMENTS

| | | |
|---|---|---|
| JP | 62-176895 | 8/1987 |
| JP | 01-298028 | 12/1989 |
| JP | 02-000080 | 1/1990 |
| JP | 03-002276 | 1/1991 |
| JP | 05-193942 | 8/1993 |
| JP | 06-019195 | 1/1994 |
| JP | 06-067453 | 3/1994 |
| JP | 07-238233 | 9/1995 |
| JP | 07-064349 | * 10/1995 |
| JP | 09-288374 | 11/1997 |
| JP | 2000-010344 | 1/2000 |
| JP | 2000-029249 | 1/2000 |
| JP | 2000-129070 | 5/2000 |
| JP | 2000-319021 | * 11/2000 |
| JP | 2001-305853 | 11/2001 |
| JP | 2002-72566 | 3/2002 |
| JP | 2002-108010 | 4/2002 |
| JP | 2002-129063 | * 5/2002 |
| JP | 2002-338706 | 11/2002 |
| JP | 2002-365850 | 12/2002 |
| JP | 2003-215846 | 7/2003 |

OTHER PUBLICATIONS

Japan Office Action dated Mar. 6, 2007, with an English translation.

* cited by examiner

*Primary Examiner*—John L Goodrow
(74) *Attorney, Agent, or Firm*—McGinn IP Law Group, PLLC

(57) ABSTRACT

An electrophotographic toner for visualizing an electrostatic latent image formed by an electrophotographic process, an electrostatic printing process, an electrostatic recording process, etc., which is produced in consideration of the environment and safety. The electrophotographic toner includes a fixing resin and a colorant. The electrophotographic toner is a black toner using a titanium compound containing no carbon black as the colorant. The electrophotographic toner may be an electrophotographic two-component black toner using magnetic iron oxide containing no carbon black as the colorant.

4 Claims, 3 Drawing Sheets

FIG. 2

| | TONER | | | | |
|---|---|---|---|---|---|
| | COLORING PIGMENT | WAX | | | |
| | | KIND | MOLECULAR WEIGHT EXPRESSED IN POLYETHTLENE (Mn) | MAXIMUM ABSORPTION PEAK (°C) | EXTERNAL ADDITIVE |
| EXAMPLE 1 | TITANIUM OXIDE (TiO) | POLYPROPYLENE WAX BISCOL 660P | 1070 | 141.2 | $SiO_2$ |
| EXAMPLE 2 | TITANIUM OXIDE (TiO) | POLYPROPYLENE WAX BISCOL 660P | 1070 | 141.2 | $TiO_2$ |
| EXAMPLE 3 | TITANIUM OXIDE (TiO) | NEOWAX AL | 430 | 98.4 | $TiO_2$ |
| EXAMPLE 4 | TITANIUM OXIDE (TiO) | PARAFFIN WAX HNP-11<br>POLYETHYLENE WAX PW1000 | 390<br>820 | 70.6<br>(109.4) | $TiO_2$<br>$SiO_2$ |
| EXAMPLE 5 | TITANIUM IRON OXIDE ($FeTiO_3$) | FISCHER-TROPSCH WAX SPRAY30 | 520 | 91.9 | $TiO_2$ |
| EXAMPLE 6 | TITANIUM IRON OXIDE ($FeTiO_3$) | PARAFFIN WAX HNP-11<br>POLYETHYLENE WAX PW1000 | 390<br>820 | 70.6<br>(109.4) | $TiO_2$<br>$SiO_2$ |
| EXAMPLE 7 | TRIIRON TETROXIDE ($Fe_3O_4$) | POLYPROPYLENE WAX BISCOL 660P | 1070 | 141.2 | $TiO_2$<br>$SiO_2$ |
| EXAMPLE 8 | TRIIRON TETROXIDE ($Fe_3O_4$) | POLYETHYLENE WAX PW1000 | 820 | 109.4 | $TiO_2$ |
| EXAMPLE 9 | TRIIRON TETROXIDE ($Fe_3O_4$) | FISCHER-TROPSCH WAX SPRAY30 | 520 | 91.9 | $SiO_2$ |
| EXAMPLE 10 | TRIIRON TETROXIDE ($Fe_3O_4$) | PARAFFIN WAX HNP-11<br>FISCHER-TROPSCH WAX SPRAY30 | 390<br>520 | 70.6<br>(91.9) | $TiO_2$<br>$SiO_2$ |
| EXAMPLE 11 | TITANIUM OXIDE ($Ti_2O_3$) | NEOWAX AL | 430 | 98.4 | $TiO_2$ |
| EXAMPLE 12 | TITANIUM OXIDE ($Ti_4O_7$) | NEOWAX AL | 430 | 98.4 | $TiO_2$ |
| COMPARATIVE EXAMPLE | CARBON BLACK | POLYETHELENE WAX BISCOL 660P | 1070 | 141.2 | $SiO_2$ |

FIG. 3

| | PRINTING CHANGE AND FIXING CHARACTERISTIC OF TONER | | | | |
|---|---|---|---|---|---|
| | IMAGE DENSITY | IMAGE DENSITY AFTER 50000 PAGES' PRINTING | NON-OFFSET TEMPERATURE RANGE (°C) | TAPE PEEL STRENGTH (%) | RUBBING STRENGTH (%) |
| EXAMPLE 1 | 1.38 | 1.28 | 185- >220 | 65 | 62 |
| EXAMPLE 2 | 1.43 | 1.43 | 185- >220 | 63 | 59 |
| EXAMPLE 3 | 1.46 | 1.43 | 170- >220 | 88 | 91 |
| EXAMPLE 4 | 1.43 | 1.42 | 165- >220 | 92 | 89 |
| EXAMPLE 5 | 1.31 | 1.32 | 170- >220 | 85 | 84 |
| EXAMPLE 6 | 1.33 | 1.32 | 165- >220 | 87 | 89 |
| EXAMPLE 7 | 1.08 | 1.06 | 185- >220 | 58 | 55 |
| EXAMPLE 8 | 1.26 | 1.26 | 170- >220 | 77 | 81 |
| EXAMPLE 9 | 1.18 | 1.17 | 165- >220 | 83 | 84 |
| EXAMPLE 10 | 1.36 | 1.33 | 165- >220 | 87 | 87 |
| EXAMPLE 11 | 1.38 | 1.36 | 170- >220 | 85 | 86 |
| EXAMPLE 12 | 1.20 | 1.18 | 170- >220 | 81 | 89 |
| COMPARATIVE EXAMPLE | 1.42 | 1.39 | 180- >220 | 68 | 64 |

ELECTROPHOTOGRAPHIC TONER AND IMAGE-FORMING SYSTEM

BACKGROUND OF THE INVENTION

1. Field of the Invention

The present invention relates to an electrophotographic toner for visualizing an electrostatic latent image formed by an electrophotographic process, an electrostatic printing process, an electrostatic recording process, etc., and an image-forming system using the electrophotographic toner.

2. Background Art

Of printing and recording processes, for example, an electrophotographic process is carried out as follows. A photoconductive photosensitive body (hereinafter referred to as "photoconductor") is electrostatically charged and exposed to light so that an electrostatic latent image is formed on the photoconductor. Then, the electrostatic latent image is developed into a toner image by a fine particle-shaped toner containing a colorant, etc. bound with a resin as a binder. The obtained toner image is transferred onto a recording medium and fixed thereto to thereby obtain a recording image.

In the electrostatic image recording process, there are used a one-component toner using only a toner for performing electrostatic charging and carrying without use of any magnetic carrier, and a two-component toner using a magnetic carrier so that a toner is mixed with the magnetic carrier in use. The one-component toner has both charging power and carrying power in itself, so that maintenance can be made easily. The one-component toner is used popularly in a small-size low-speed system. On the other hand, the two-component toner is used popularly in a large-size high-speed system because of charge and printing stability, good fixing characteristic, etc. in spite of use of the magnetic carrier.

Attention to the environment and ecosystem has been recently demanded more strongly than ever. Materials used in such toners have begun to be examined closely before use. Particularly in a large-size high-speed system, the amount of the toner used becomes relatively large, so that the required level of safety becomes stringent. Development of a toner paying more attention to the environment and safety than ever has been demanded. In addition, a toner capable of being fixed at a low temperature has been demanded with the advance of increase in speed, reduction in fixing energy, and so on.

SUMMARY OF THE INVENTION

The problem that the invention is to solve is in an electrophotographic toner and an image-forming system, that is, an object of the invention is to provide an electrophotographic toner paying more attention to the environment and safety, and an image-forming system using the electrophotographic toner.

The present inventors have made eager examination to solve the problem. As a result, it has been found that the problem can be solved when an electrophotographic toner using a titanium compound as at least one colorant but substantially containing no carbon black is provided, when the titanium compound is titanium oxide or titanium iron oxide, when the toner is a two-component toner, when the toner contains titanium dioxide ($TiO_2$) as an external additive and when the toner is used so that the maximum of absorption peaks in a heat-up time absorption calorie curve in a DSC curve measured by a differential scanning calorimeter is in a range of from 50° C. to 120° C.

It has been also found that the problem can be solved when an electrophotographic two-component toner using magnetic iron oxide as at least one colorant but substantially containing no carbon black is provided, when the toner contains titanium dioxide ($TiO_2$) as an external additive and when the toner is used so that the maximum of absorption peaks in a heat-up time absorption calorie curve in a DSC curve measured by a differential scanning calorimeter is in a range of from 50° C. to 120° C.

It has been further found that the problem can be solved when the toner is used in an image-forming system including an electrostatic charge holding member, a developing portion using an electrophotographic toner for actualizing an electrostatic charge latent image formed on the electrostatic charge holding member, a transfer portion for transferring the actualized toner image onto a recording medium, a cleaning portion for cleaning up the toner image remaining on the electrostatic charge holding member, and a fixing portion for fixing the toner image transferred onto the recording medium, and when the toner is a two-component toner using a magnetic carrier and the developing portion uses at least a plurality of developing magnetic rolls which are center feed type developing magnetic rolls which are constituted by developing magnetic rolls rotating in a forward direction and developing magnetic rolls rotating in a backward direction with respect to a direction of movement of the electrostatic charge holding member.

BRIEF DESCRIPTION OF THE DRAWINGS

The present invention may be more readily described with reference to the accompanying drawings:

FIG. 2 is a view showing a list of contents in Examples and Comparative Example.

FIG. 3 is a view showing a list of contents in Examples and Comparative Example.

DETAILED DESCRIPTION OF THE PREFERRED EMBODIMENTS

Figure 1:
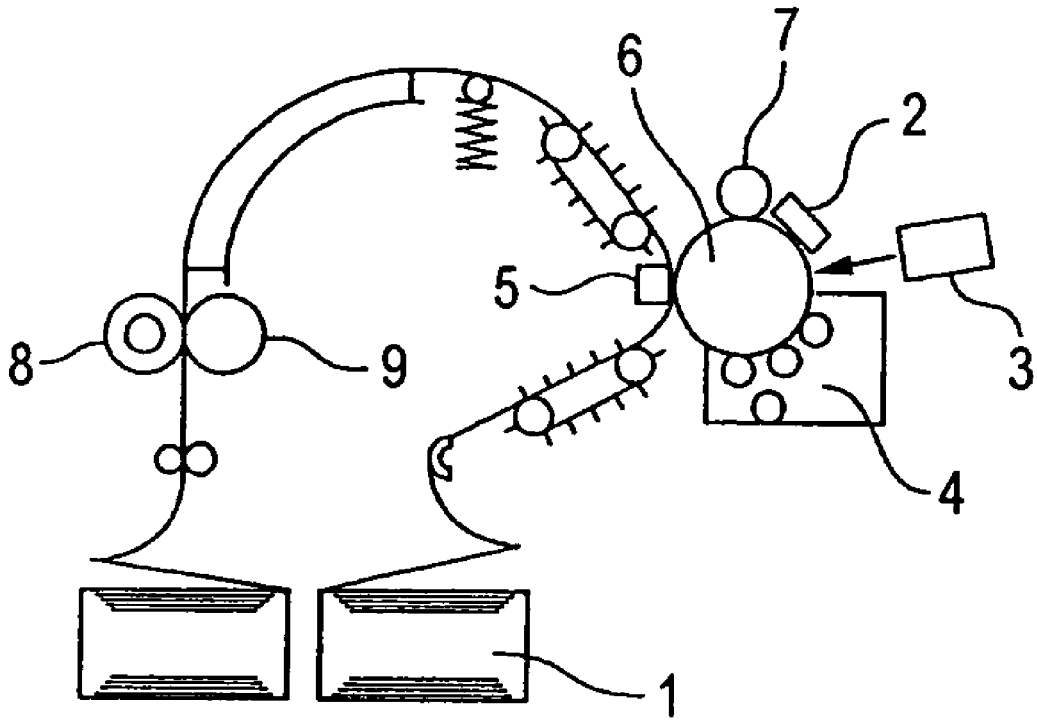
FIG. 1 is a schematic configuration view of an image-forming system according to an embodiment of the invention.

The invention will be described below in detail.

In order to visualize an electrostatic latent image formed on a photoconductor in an electrophotographic process, it is essential to mix a colorant represented by a dye, a pigment, etc. with a toner. The electrostatic latent image can be visualized by the toner. In a two-component black toner using a magnetic carrier, carbon black is used popularly as a colorant for visualizing such an electrostatic latent image.

One-component black toners are roughly classified into magnetic one-component toners of the type containing a magnetic material and non-magnetic one-component toners of the type containing no magnetic material in order to maintain the carrying power of the toners. In the magnetic one-component black toner, magnetic iron oxide is generally used from the point of view of both portability and colorability and carbon black may be used in combination with the magnetic iron oxide. In the non-magnetic one-component black toner, carbon black is used popularly like the two-component black toner. The toner largely depends on excellent colorability, hiding power, dispersibility, electrical conductivity, etc. of the carbon black.

On the other hand, the particle size of the toner is showing a tendency to decrease with the needs of improving image quality more greatly. The toner particles are so fine that the toner particles are apt to be diffused into the air, for example, when the toner particles are ejected from the system. There is an undeniable possibility that a human being will be exposed to the toner particles. It is therefore necessary to select a safer material as the colorant which is an essential constituent member of the toner.

There is however the fact that safety of carbon black has been reevaluated on the market in recent years. IARC (International Agency for Research on Cancer) reevaluated safety of carbon black from Group 3 (in which evidence for deciding carcinogenicity is insufficient) to Group 2B (in which there is a possibility of carcinogenicity to human beings because carcinogenicity to animals is known) on Apr. 12, 1996. On the other hand, the opinion that the IARC's reevaluation was based on research on rats' inhalation of carbon black but on the ground of insufficient evidence for the same condition applied to human beings and other animals was reported. The development of arguments from now will have to be watched intently.

It is also known that carbon black contains a very small amount of nitropyrene which is a carcinogenic substance. In the actual situation, carbonblackas low in nitropyrene content as possible is selected in use.

We have made eager examination to provide a black toner containing no carbon black in compliance with the needs for safety on the market and have come to the conclusion that a titanium compound should be used as the colorant. Examples of the titanium compound include: compounds having oxidation numbers of −1, 0, 2, 3 and 4; alloys of titanium and Al, Cr, Fe, Mn, Mo, V, etc.; titanium iron oxide; titanic iron ore; titanate; strontium titanate; lead titanate; and barium titanate.

Unsafety of these substances for human body has not been pointed out for the present. These substances have such characteristic that the toner little scatters because these substances are higher in specific gravity than carbon black (e.g., the specific gravity of TiO is 4.9 whereas the specific gravity of carbon black is 1.8) and because these substances may be often slightly magnetized so that these substances can be easily collected by a magnet roller.

The titanium compound is selected in accordance with a required color tone. The titanium compound may be used singly or may be used in combination with the other colorant. In the case of a black toner, bivalent titanium oxide (TiO), lower titanium oxide, titanium iron oxide, titanium iron ore, etc. can be used.

When bivalent titanium oxide (TiO) is used, titanium oxide (TiO) obtained by reduction of titanium dioxide ($TiO_2$), being not magnetic, exhibiting oil absorption of not higher than 80 ml/100 g, preferably oil absorption in a range of from 20 ml/100 g to 60 ml/100 g and having a BET specific surface area of not larger than 100 $m^2/g$, preferably a BET specific surface area in a range of from 10 $m^2/g$ to 80 $m^2/g$ is preferably used as the bivalent titanium oxide (TiO). This is because fixing characteristic is spoiled if the oil absorption becomes higher and the BET specific surface area becomes larger. Further, titanium oxide having a resistance value in a range of from 0.1 to 1000 (Ω·cm) and a primary particle size in a range of from 0.03 to 0.5 (μm) is preferably used as the bivalent titanium oxide.

Lower titanium oxide represented by the general formula $Ti_nO_{2n-1}$ can be also used. The lower titanium oxide can be prepared by heating a mixture of titanium dioxide and metallic titanium in a vacuum. The lower titanium oxide represented by the general formula $Ti_nO_{2n-1}$ has such characteristic that the color tone varies to bronze, purplish black, bluish black, gray and white successively as the value of n in the formula increases. In the invention, black lower titanium oxide represented by the general formula $Ti_nO_{2n-1}$ in which n is in a range of from 1 to 5 is used preferably.

On the other hand, in a magnetic one-component toner, magnetic iron oxide is generally used as a colorant substituted for carbon black. The magnetic iron oxide is called "triiron tetroxide ($Fe_3O_4$)" and exhibits black. The magnetic iron oxide may be mixed with the other colorant in accordance with the hue. Alternatively, ã??? iron monoxide may be used. When magnetic iron oxide is used in a two-component toner, there is however a problem that magnetic force of the magnetic iron oxide makes it difficult to separate the magnetic iron oxide from the magnetic carrier.

When magnetic iron oxide is used as a colorant in a two-component toner, a method for improving developing performance in the developing portion or a method for separating the toner from the magnetic carrier easily is required. For example, a method for improving the developing capacity of the developing unit by increasing the number of magnet rollers to widen the developing region or by increasing the rotational speed of each magnet roller can be used. Further, as improvement on the toner/developing agent side, reduction in carrier resistance, reduction in quantity of electric charge, increase in quantity of the external additive added to toner surfaces and increase in particle size of the external additive are effective when a reversal developing method is used.

Especially, as the method for separating the toner from the magnetic carrier easily, a method of increasing the particle size of the external additive to substantially enlarge the distance between the carrier and the toner may be used so that the aforementioned problem can be solved. The primary particle size of the external additive used in this case is preferably selected to be not smaller than 20 nm. Especially when the primary particle size of the external additive is not smaller than 30 nm, the toner and the carrier can be easily separated from each other by the external additive. On this occasion, another external additive may be used in combination with the external additive in order to adjust fluidity, electrostatic property, etc.

Moreover, in the case of a toner using a titanium compound or magnetic iron oxide as a colorant, electrostatic charge may be accumulated to increase the quantity of electrostatic charge. Because carbon black has good electrical conductivity, carbon black has an effect of keeping stability of electrostatic charge by a function of releasing electrostatic charge through carbon black exposed on toner surfaces, and has an effect of adjusting resistance. When a titanium compound or magnetic iron oxide is used as a colorant, electrostatic charge, however, has a tendency to be accumulated because the titanium compound or magnetic iron oxide is lower in electrical conductivity than carbon black so that electrostatic charge can be hardly released as well as the titanium compound or magnetic iron oxide is higher in resistance value than carbon black. In this case, the quantity (Q/M) of charge of the toner increases. As a result, when reversal development is used, the image density becomes so low that the toner becomes poor in printing quality.

Further, toner surfaces are generally covered with silica so that electrostatic property and fluidity of the toner can be given to the toner surfaces. Silica is however very high in resistance, so that an effect of releasing electrostatic charge cannot be expected. Therefore, a method of adding an electrically conducting material to toner surfaces to provide an effect of releasing electric charge is known. Carbon black is however generally used as the electrically conducting material. If carbon black is added to toner surfaces, a great deal of liberated carbon black is produced so that the original object of the invention cannot be achieved. Although another material such as metal powder or a material doped with metal powder than carbon black may be used as the electrically conducting material, inmost cases, fluidity cannot be provided in accordance with the particle size, particle shape, etc. of the electrically conducting material.

Titanium dioxide ($TiO_2$) can be used as an external additive which serves also as a material having an effect of preventing accumulation of electric charge over a predetermined quantity and releasing electric charge. The resistance value of titanium dioxide ($TiO_2$) is high when titanium dioxide ($TiO_2$) is used as an electrically conducting material but is low compared with that of silica. In the case of a toner using a titanium compound, titanium dioxide ($TiO_2$) contained in toner surfaces has an advantage in that titanium dioxide ($TiO_2$) is effective in suppressing increase of electrostatic charge to obtain stable printing and also effective in reducing toner surface resistance.

The use of titanium dioxide ($TiO_2$) as an external additive of the toner has been already made practicable. When a titanium compound or magnetic iron oxide is used as a colorant combined with a black toner without of use of carbon black, titanium dioxide ($TiO_2$) is remarkably effective particularly in stabilizing electrostatic charge.

It is further known that silica popularly used as an external additive contains silicon oxide as a constituent member and that free silicon from silica causes pneumoconiosis. Accordingly, the use of titanium dioxide ($TiO_2$) in a black toner without use of carbon black to pay attention to the environment and safety is also significant from this point of view.

On the other hand, in order to reduce today's load imposed on the environment, when the heat capacity of a fixing unit is reduced from the device side, energy saving to reduce standby energy can be promoted and has begun to be put into practical use.

With respect to the toner, a toner capable of being fixed at a low temperature has been required. To fix the toner at a low temperature, it is effective that the toner can be melted by a low quantity of heat, permeate a recording medium such as a sheet of paper and be solidified in the recording medium to exhibit an anchoring effect to thereby obtain strength against peeling easily.

Heretofore, wax was contained as a high-temperature offset preventing material in the toner. Wax is sensitive in the change of viscosity according to the temperature. Because wax is melted to have low viscosity when the temperature reaches a predetermined value, viscosity at the fixing temperature can be made so low that the toner can easily permeate the sheet of paper easily and be solidified in the inside of the sheet of paper to bring about the anchoring effect. For this reason, when the toner contains low-melting wax, a high peeling strength can be obtained at a low temperature.

The melting temperature of the toner can be measured by a differential scanning calorimeter. The maximum of absorption peaks in a heat-up time absorption calorie curve in a DSC curve is preferably in a range of from 50° C. to 120° C. In the case of a toner containing a titanium compound or magnetic iron oxide as a colorant without use of carbon black, the titanium compound or magnetic iron oxide is inferior in coloring or hiding power of the pigment per se to carbon black. In order to obtain the same black as carbon black, it is necessary to increase the amount of the titanium compound or magnetic iron oxide contained in the toner.

As a result, fixing characteristic is lowered. When the maximum of absorption peaks in a heat-up time absorption calorie curve in a DSC curve is selected to be in a range of from 50° C. to 120° C., the melting viscosity of the toner can be reduced to compensate for the disadvantage caused by the absence of carbon black so that fixing at a lower temperature can be performed. If the maximum of absorption peaks in a heat-up time absorption calorie curve in a DSC curve is lower than 50° C., the toner is melted to cohere easily during the storage so that a spent phenomenon of the toner melted and deposited on carrier surfaces during continuous printing occurs easily, undesirably.

On the other hand, if the maximum of absorption peaks in a heat-up time absorption calorie curve in a DSC curve is higher than 120° C., the object to melt the toner at a low temperature to improve lowering of fixing characteristic caused by the pigment change to perform fixing at a low temperature cannot be achieved. Accordingly, the maximum of absorption peaks in a heat-up time absorption calorie curve in a DSC curve is selected to be in a range of from 50° C. to 120° C., preferably in a range of from 50° C. to 100° C., more preferably in a range of from 50° C. to 80° C. Moreover, addition of wax is effective in preventing rubbing of the sheet of paper.

In recent years, the printed image of a sheet of paper subjected to double-sided printing, multiple printing, scaling-down and editing printing, or the like, was rubbed while the sheet of paper passed through the device many times. Therefore, higher durability against rubbing than the durability in the related art is required. Wax contained in the toner is effective in improving durability against the rubbing. Even in the case where the toner image and the sheet of paper rub with each other, the lubricant effect of wax exuded from toner surfaces can prevent the sheet of paper adjacent to the printed sheet of paper from being stained by rubbing.

This effect of durability against rubbing appears remarkably when a great deal of printing matters are piled up and printed, when the toner is used in an image reader or the like having an automatic paper feeding mechanism or when printing is performed on thick sheets of paper such as name cards and cards. A good result can be obtained in the printing speed ranging from a low speed to a high speed. Particularly in a high-speed (processing speed of not lower than 300 mm/s) region, a more remarkable effect can be obtained.

The electrophotographic toner according to the invention can have an effect on both tape peeling strength and rubbing strength because the maximum of absorption peaks in a heat-up time absorption calorie curve in a DSC curve measured by a differential scanning calorimeter is in a range of from 50° C. to 120° C.

The DSC curve of the toner is measured as follows. About 5 mg of the toner is weighed and put on the DSC. Nitrogen gas at a rate of 50 ml per minute is blown into the DSC. The toner is heated from 20° C. to 160° C. at a rate of 10° C. per minute. Then, the toner is cooled rapidly from 160° C. to 20° C. After previous history is recorded, the toner is heated again at a rate of 10° C. per minute. Peaks in a DSC absorption calorie curve in this condition are obtained.

The molecular weight distribution of the wax in the invention is measured by gel permeation chromatography (GPC) at a high temperature in the following condition.

(GPC Measuring Condition)

Apparatus: ALC/GPC 150-C (made by Waters Corp.)

Separation Column: GMH-HT60 cm×1, GMH-HTL60 cm×1 (made by Tosoh)

Column Temperature: 135° C.

Mobile Phase: o-dichlorobenzene

Detector: differential refractometer

Flow Rate: 1.0 ml/min

Sample Concentration: 0.15% by weight

Injection Quantity: 400 μl

Measurement is made in the condition. The molecular weight of the sample is calculated by using a molecular weight calibration curve generated on the basis of a monodisperse polystyrene standard sample and by using a conversion equation deduced from Mark-Houwink-Sakurada's equation or a viscosity equation for expressing the molecular weight in terms of the molecular weight of polyethylene.

The crystallinity of the wax is measured by an X-ray diffraction method in the following condition.

X-Ray: Cu—Kα ray (monochromated by a graphite monochromator)

Wavelength λ: 1.5406 Å

Output: 40 kV, 40 mA

Optical System: reflecting method, slit DS, SS=1°, RS=0.3 mm

Measuring Range: 2θ=10° to 35°

Step Interval: 0.02°

Scanning Speed: 2θ/θ continuous scanning 1.00°/min

Measurement is made in the condition. The X-ray diffraction profile of the sample is separated into three crystal peaks and amorphous scattering. The crystallinity of the sample is calculated on the basis of areas of the crystal peaks and amorphous scattering by the following equation.

$$\text{Crystallinity } (\%) = Ic/(Ic+Ia)\times 100$$

in which Ic is the sum of the areas of the crystal peaks, and Ia is the sum of the areas of the crystal peaks and the area of the amorphous scattering.

Various kinds of wax can be used as the wax in the invention. The wax can be selected according to its function. For example, natural wax or synthetic wax can be used. Specifically, polypropylene wax, polyethylene wax, Fischer-Tropsch wax, paraffin wax, carnauba wax, etc. can be used. The number-average molecular weight of the used wax expressed in terms of the molecular weight of polyethylene is preferably not larger than 1000. The amount of the wax contained in 100 parts by weight of the fixing resin is from 0.1 parts by weight to 20 parts by weight. Several kinds of wax may be used in combination.

Examples of the fixing resin used in the toner according to the invention include:

homopolymers of styrene and substituted styrene such as polystyrene, poly-p-chlorstyrene, and polyvinyltoluene;

styrene-based copolymers such as styrene-p-chlorstyrene copolymer, styrene-vinyltoluene copolymer, styrene-vinylnaphthalene copolymer, styrene-acrylic ester copolymer, styrene-methacrylic ester copolymer, styrene-methyl α-chlormethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, and styrene-acrylonitrile-indene copolymer; and polyvinyl chloride, phenol resin, natural modified phenol resin, natural resin-modified maleic resin, acrylic resin, methacrylic resin, polyvinyl acetate, silicone resin, polyester resin, polyurethane resin, polyamide resin, furan resin, epoxy resin, xylene resin, polyvinyl butyral, terpene resin, chroman-indene resin, and petroleum resin.

Preferably, styrene-based copolymer or polyester resin may be used as the fixing resin.

A low hygroscopic resin obtained by graft copolymerization of the polyester resin and styrene or acryl can be also used. Incidentally, the styrene-based polymer or the styrene-based copolymer may be crosslinked or may be a mixture of resins. In order to perform fixing at a low temperature and prevent high-temperature offset, for example, in the case of styrene to (meth) acrylic resin, the fixing resin may be constituted by a mixture of a high molecular weight polymer and a low molecular weight polymer. The former is effective in securing offset yield strength of the toner. The latter is effective in securing fixing strength of the toner. Composition balance between the two components is important to coexistence of the low-temperature fixing characteristic and the offset yield strength. It is further said that the balance has influence on storage stability.

As the molecular weight distribution of the fixing resin, tetrahydrofuran-soluble components can be measured by gel permeation chromatography (GPC). In the case of styrene to (meth) acrylic resin, when the fixing resin is selected to contain a high molecular weight polymer component having molecular weight higher than 500000 in GPC measurement, and a low molecular weight polymer component having molecular weight of not higher than 20000 in GPC measurement at a ratio ranging from 20:80 to 60:40, both low-temperature fixing characteristic and offset yield strength can be achieved.

To improve mutual solubility of the fixing resin and the wax, the fixing resin may be synthesized by a copolymerization method in coexistence with the wax in all or part of a synthesis process.

In the method for generating the fixing resin in the presence of the wax by the copolymerization method, the vinyl-based copolymer may contain styrene-based monomer and/or (meth) acrylic ester monomer, and other vinyl-based monomer as constituent units.

When the copolymerization in coexistence with the wax is carried out in all or part of synthesis in the invention, a vinyl-based copolymer containing the wax dispersed uniformly can be at least obtained as a constituent member. Incidentally, the vinyl-based copolymer may be partially crosslinked by a polymerizable monomer having at least two double bonds, e.g., a crosslinker such as divinylbenzene, divinylnaphthalene, ethylene glycol dimethacrylate, 1,3-butanediol dimethacrylate, divinylaniline, divinyl ether, divinylsulfide, or divinylsulfone.

Specific examples of the styrene-based monomer as a constituent unit of the vinyl polymer include styrene, orthomethylstyrene, meta-methylstyrene, alpha-methylstyrene, and 2,4-dimethylstyrene.

Specific examples of the acrylic ester or methacrylic ester-based monomer as a constituent unit of the vinyl polymer include: acrylic or methacrylic alkyl ester such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, methyl methacrylate, ethylmethacrylate, propylmethacrylate, n-butylmethacrylate, isobutyl methacrylate, n-octyl methacrylate, dodecyl methacrylate, and stearyl methacrylate; and 2-chlorethyl acrylate, phenyl acrylate, methyl α-chloracrylate, phenyl methacrylate, dimethylaminoethyl methacrylate, diethylaminoethyl methacrylate, 2-hydroxyethyl methacrylate, glycidylmethacrylate, bisglycidylmethacrylate, polyethylene glycol dimethacrylate, and methacryloxyethyl phosphate. Particularly, ethyl acrylate, propyl acrylate, butyl acrylate, methyl methacrylate, ethyl methacrylate, propyl methacrylate, butyl methacrylate, etc. can be used preferably.

Examples of the other vinyl-basedmonomer as a constituent unit of the vinyl polymer include: acrylic acid and its α- or β-alkyl derivatives such as acrylic acid, methacrylic acid, α-ethyl acrylate, and crotonic acid; unsaturated dicarboxylic acid and its monoester and diester derivatives such as fumaric acid, maleic acid, citraconic acid, and itaconic acid; and succinic monoacryloyloxyethyl ester, succinic monomethacryloyloxyethyl ester, acrylonitrile, methacrylonitrile, and acrylamide.

It is a matter of importance to the environment and safety that the resin contains monomer components which have been not polymerized yet in the synthesis process, and the residue of organic solvent and polymerization initiator. It is therefore preferable that a resin is used after a volatile component of the resin is removed in a high-temperature and reduced-pressure condition as sufficiently as possible when the resin is produced. When the resin is melted and kneaded in the toner producing process, the volatile component may be also removed by reduction of pressure at the time of kneading to thereby obtain greater improvement.

The toner according to the invention may contain an charge control agent as an internal or external additive in toner particles so that the quantity of electrostatic charge of the toner can be controlled to a desired value.

Examples of an agent for controlling electrostatic positive charge of the toner include: modified materials due to nigrosine, and aliphatic metal salt; quaternary ammonium salts such as tributylbenzylammonium-1-hydroxy-4-naphthosulfonic acid and tetrabutylammonium tetrafluoroborate, onium salts such as phosphonium salts which are analog to the quaternary ammonium salts, and lake pigments thereof; triphenylmethane dyes and lake pigments thereof; higher fatty acid metal salts; diorganotin oxide such as dibutyltin oxide, dioctyltin oxide, and dicyclohexyltin oxide; and diorganotin borate such as dibutyltin borate, dioctyltin borate, and dicyclohexyltin borate. Any one selected from these examples of the agent may be used singly or two or more kinds selected from these examples of the agent maybe used in combination. Particularly, a charge control agent such as a nigrosine-based compound, quaternary ammonium salt or triphenylmethane dye can be used preferably.

An organometallic complex or a chelate compound is effectively used as an agent for controlling electrostatic negative charge of the toner. For example, a monoazo metallic complex, an acetylacetone metallic complex, an aromatic hydroxycarboxylic metallic complex or an aromatic dicarboxylic metallic complex may be used. Other examples include: aromatic hydroxycarboxylic acid, aromatic mono- and poly-carboxylic acid and metal salts, anhydrides and esters thereof; and phenol derivatives such as bisphenol.

When these charge control agents are to be internally added to the toner, it is preferable that 0.1% by weight to 10% by weight of the charge control agents are added to the fixing resin. The charge control agent needs to be selected carefully enough because it may have skin sensitizing property according to its structure.

Fine powder of titanium dioxide ($TiO_2$) or the like may be preferably externally added into the toner according to the invention in order to improve developing characteristic, fluidity, charge stability and durability.

Preferably, the fine powder of titanium dioxide ($TiO_2$) or the like used in the invention has a primary particle size of not smaller than 20 nm. The amount of the fine powder of titanium dioxide ($TiO_2$) or the like externally added into the toner is in a range of from 0.01% by weight to 10% by weight. Silica may be also added as occasion demands. The fine powder may be used after surfaces of the fine powder are treated with a treating agent such as an organic silicon compound, or various kinds of treating agents so that hydrophobic characteristic and charge characteristic can be controlled. The fine powder and the treating agents can be selected in accordance with the purpose because fluidity, durability, storage stability, etc. vary according to the kind of the treating agent and the particle size of the fine powder.

Lubricant powder such as polytetrafluoroethylene resin powder, zinc stearate powder or polyvinylidene fluoride powder may be further used. Particularly, polyvinylidene fluoride is used preferably. An abrasive such as cerium oxide powder, silicon carbide powder or strontium titanate powder may be further used. Particularly, strontium titanate powder is used preferably. A fluidizing agent such as aluminum oxide powder may be further used. Particularly, a hydrophobic fluidizing agent is used preferably. An anticoagulant, an electrical conduction-donating agent such as zinc oxide powder, antimony oxide powder or tin oxide powder, or a development enhancing agent such as reversed-polarity white fine particles and black fine particles may be further used by a small amount.

There are various methods for measuring the particle size of the toner. In the invention, the particle size of the toner is measured by a Colter counter. That is, a Colter counter TA-II (made by Coulter Electronics Inc.) with an aperture of 100 μm is used as a measuring device for measuring a number distribution and a volume distribution. On this occasion, a measurement toner is added into an electrolytic solution containing a surface active agent and dispersed for 1 minute by an ultrasonic dispersing device to obtain a measurement sample. 50000 particles of the sample are measured. The mean particle size of the toner is preferably selected to be in a range of from 4 μm to 10 μm. It is further preferable that the percentage of particles contained in the toner and not larger than 4 μm is suppressed to be not higher than 25%.

The electrophotographic toner according to the invention is produced as follows. A fixing resin, a charge control agent, a pigment or dye as a colorant and magnetic powder are mixed sufficiently by a mixer such as a Henschel mixer or a super mixer while combined with a fixing resin containing additives and wax dispersed therein uniformly as occasion demands. Then, the mixture is melted and kneaded by a heat-melt kneading device such as a heating roll, a kneader or an extruder so that the raw materials are mixed sufficiently. Then, after cooled and solidified, the mixture is pulverized and classified to thereby obtain the toner.

As the pulverizing method used on this occasion, a jet mill method, an interparticle collision method or a mechanical pulverizing method can be used. In the jet mill method, the toner included in a high-speed air current is made to collide with a collision plate so that the toner is pulverized by energy of the collision. In the interparticle collision method, toner particles are made to collide with one another in an air current. In the mechanical pulverizing method, the toner is supplied into a narrow gap between rotors rotating at a high speed to thereby be pulverized.

The toner particles obtained by the jet mill method or the interparticle collision method are relatively sharp in shape because the toner is pulverized by collision energy. When the mechanical pulverizing method is used, the toner is however pulverized while rubbed in the gap, and the toner surfaces are apt to be spherically shaped by frictional heat generated on this occasion. As occasion demands, desired additives are deposited on and mixed with the pulverized and classified toner by a mixer such as a Henschel mixer. Thus, the toner containing the additives externally added thereto can be obtained. The toner can be also obtained by a so-called polymerization method in which a colorant, a charge control agent, wax, etc. are dispersed and polymerized at the time of reaction of the resin monomer.

A known material can be used as the carrier in the invention. For example, a resin carrier containing a binder resin, and iron powder, ferrite, magnetite, glass beads and magnetic fine particles dispersed into the binder resin can be used. A coating layer may be provided on each of carrier surfaces. The charge characteristic, electric resistance value, etc. of the carrier can be controlled by the binder resin, the electrostatic chargeable fine particles and the coating layer.

Examples of the binder resin used in the resin carrier include: thermoplastic resins such as a vinyl-based resin, a polyester-based resin, a Nylon-based resin, and a polyolefin-based resin; and thermosetting resins such as a phenol resin.

Examples of the magnetic carrier may include: magnetite; spinel ferrite such as gamma-iron oxide; spinel ferrite containing at least one kind selected from other metals (Mn, Ni, Zn, Mg, Cu, etc.) than iron; magnetoplumbite type ferrite such as barium ferrite; and iron or alloy particles each having an oxide layer in its surface. The shape of the magnetic carrier may be granular, spherical or needle-like. Particularly when high magnetization is required, ferromagnetic fine particles of iron or the like may be preferably used.

In consideration of chemical stability, magnetite, spinel ferrite containing gamma-iron oxide or magnetoplumbite type ferrite such as barium ferrite may be preferably used. When the kind and amount of the ferromagnetic fine particles are selected, the resin carrier having desired magnetization can be used. The magnetic characteristic of the carrier on this occasion is preferably selected so that the intensity of magnetization is 30 emu/g to 150 emu/g at 1000 Oe.

The resin carrier can be produced as follows. A melted and kneaded mixture of fine particles of a magnetic substance and an electrically insulating binder resin is sprayed by a spray dryer to thereby produce the resin carrier. Alternatively, a monomer or pre-polymer is subjected to a reaction and hardened in an aqueous solvent in the presence of fine particles of a magnetic substance to thereby produce the resin carrier containing the fine particles of the magnetic substance dispersed into a condensation type binder.

Charge characteristic can be controlled when electrostatically positively or negatively charged fine particles or electrically conductive fine particles are fixed onto surfaces of the magnetic carrier or when surfaces of the magnetic carrier are coated with a resin.

A silicone resin, an acrylic resin, an epoxy resin, a fluororesin, or the like, may be used as the surface coating material. The surface coating material may contain electrostatically positively or negatively charged fine particles or electrically conductive fine particles.

The mixture ratio of the toner to the carrier in the invention is preferably selected so that the toner concentration is 2% by weight to 10% by weight.

In an electrostatic image recording process including the steps of: visualizing an electrostatic latent image formed on an electrostatic charge holding member by using the toner; transferring the visualized toner image onto a recording medium; and fixing the toner image transferred onto the recording medium while cleaning the toner image remaining on the electrostatic charge holding member to thereby obtain a recording image, the electrophotographic toner according to the invention can be used for providing a stable electrostatic toner image-forming method which exhibits good fixing performance particularly even at a low temperature and in which good resistance to rubbing and good fluidity, heat resistance, durability and storage stability of the toner can be obtained.

The developing unit used in the invention can be selected in accordance with the moving speed of the electrostatic charge holding member. In the case of a high-speed printer in which the moving speed of the electrostatic charge holding member is high, a plurality of developing magnetic rolls may be preferably used so that developing can be performed while he developing region is enlarged and the developing time is elongated because developing cannot be performed sufficiently by one developing magnetic roll. When such a plurality of developing magnetic rolls are used, a high developing capacity is obtained compared with the system using one developing roll. As a result, measures against large-area image printing and improvement of print quality can be attained. Moreover, the toner content of the developing agent can be reduced. In addition, the rotational speed of each developing roll can be reduced. Accordingly, the carrier can be prevented from being spent by the toner due to scattering of the toner and reduction in load imposed on the developing agent. As a result, the developing agent can be further long-lived.

In the developing method using the plurality of developing rolls, a high developing capacity is obtained in a one-way development in which the developing rolls rotate in a forward direction with respect to the direction of movement of the electrostatic charge holding member, but drawbacks such as background fog, lack of image edges and brush mark of a magnetic brush are apt to occur.

On the other hand, in a one-way development in which the developing rolls rotate in a reverse direction with respect to the direction of movement of the electrostatic charge holding member, lack of the image rear edge occurs but both background fog and brush mark of a magnetic brush little occur, so that a stable image can be obtained. In the reverse-direction development, the developing capacity may be however small because the effective amount of the toner coming into contact with the electrostatic charge holding member is small. On the contrary, in a center feed method having developing rolls rotating in a forward direction and also having developing rolls rotating in a reverse direction, the drawbacks of the two developing methods can be avoided. A center feed type developing unit is known, for example, from JP-B-62-45552.

When the developing method is used in combination with the electrophotographic toner according to the invention, an excellent image can be obtained and energy required for fixing the image is low. Moreover, when a heat roller fixing method is used, the temperature and pressure of the heat roller can be reduced. Moreover, an offset phenomenon hardly occurs. The toner is excellent in fluidity, heat resistance, durability and storage stability. The carrier can be prevented from being spent by the toner, so that the life of the developing agent can be prevented from being reduced due to the carrier spent. The photoconductor can be prevented from being filmed with the toner, so that the life of the photoconductor can be prevented from being reduced due to the filming of the photoconductor. Accordingly, a stable image can be produced.

FIG. 1 is a configuration view of an image-forming system using a continuous sheet of paper. In FIG. 1, the reference numeral 1 designates a sheet of paper; 2, a charger;

3, a light source; 4, a developing unit (developing portion) filled with the electrophotographic toner according to the invention; 5, a transfer unit (transfer portion); 6, a photoconductor (electrostatic charge holding member); 7, a cleaner (cleaning portion); 8, a heating roll (fixing portion); and 9, a pressurizing roll (fixing portion). The respective constituent members are arranged as shown in FIG. 1. Incidentally, the process for forming an image is the same as the related-art process and the description thereof will be therefore omitted.

Examples according to the invention will be described below but the invention is not limited thereto.

EXAMPLE 1

Raw materials containing 85% by weight of a styrene-acrylic copolymer resin (trade name: Hymer SB316 made by Sanyo Chemical Industries, Ltd., Mw=238000, Mn=3500), 1% by weight of a charge control agent (trade name: T-77 made by Hodogaya Chemical Co., Ltd.), 10% by weight of titanium oxide (TiO) (particle size: 0.3 μm, oil absorption: 32 ml/100 g, BET specific surface area: 25 $m^2/g$) and 4% by weight of polypropylene wax (trade name: BISCOL 660P made by Sanyo Chemical Industries, Ltd., Mn=1070 as molecular weight expressed in polyethylene, DSC heat absorption peak: 141.2° C.) were preparatorily mixed by a super mixer and kneaded while heat-melted by a biaxial kneader. Then, the mixture was cooled, pulverized and classified by a dry air current classifier to thereby obtain particles having a mean particle size of 9 μm.

Into the particles, 0.6% by weight of hydrophobic silica (trade name: R974 made by Nippon Aerosil Company, primary particle size: 12 nm) were added and stirred by a Henschel mixer so that the hydrophobic silica was deposited on surfaces of the particles. Thus, a toner of Example 1 was obtained. Incidentally, the mean particle size of the toner on this occasion was 9.0 μm.

EXAMPLE 2

A toner of Example 2 was produced in the same manner as in Example 1 except that 1.0% by weight of titanium dioxide ($TiO_2$) (tradename: T-805 made by Nippon Aerosil Company, primary particle size: 21 nm) were used as an external additive.

EXAMPLE 3

A toner was produced in the same manner as in Example 1 except that 87% by weight of a styrene-acrylic copolymer resin (tradename: Hymer SB316 made by Sanyo Chemical Industries, Ltd., Mw=238000, Mn=3500), 1% by weight of a charge control agent (trade name: T-77 made by Hodogaya Chemical Co., Ltd.), 8% by weight of titanium oxide (TiO) (particle size: 0.1 μm, oil absorption: 32 ml/100 g, BET specific surface area: 40 $m^2/g$) and 4% by weight of polyethylene wax (trade name: NEOWAX AL made by Yasuhara Chemical Co., Ltd., Mn=430 as molecular weight expressed in polyethylene, DSC heat absorption peak: 98.4° C., melting viscosity: 8.5 cp at 140° C., crystallinity: 83%) were used.

Into the particles, 1.0% by weight of titanium dioxide ($TiO_2$) (tradename: T-805 made by Nippon Aerosil Company, primary particle size: 21 nm) was added and stirred by a Henschel mixer so that the titanium dioxide was deposited on surfaces of the particles. Thus, a toner of Example 3 was obtained. Incidentally, the mean particle size of the toner on this occasion was 8.8 μm.

EXAMPLE 4

A toner was produced in the same manner as in Example 1 except that 87% by weight of a styrene-acrylic copolymer resin (tradename: Hymer SB316 made by Sanyo Chemical Industries, Ltd., Mw=238000, Mn=3500), 1% by weight of a charge control agent (trade name: T-77 made by Hodogaya Chemical Co., Ltd.), 8% by weight of titanium oxide (TiO) (particle size: 0.1 μm, oil absorption: 32 ml/100 g, BET specific surface area: 40 $m^2/g$), 1.5% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 2.5% by weight of polyethylene wax (trade name: PW1000 made by Toyo Petrolite Co., Ltd., Mn=820 as molecular weight expressed in polyethylene, DSC heat absorption peak: 109.4° C., melting viscosity: 13.7 cp at 140° C., crystallinity: 90%) were used.

Into the particles, 0.6% by weight of titanium dioxide ($TiO_2$) (tradename: STT-60J made by Titan Kokyo Kabushiki Kaisha, primary particle size: 50 nm) and 0.3% by weight of hydrophobic silica (tradename: R976 made by Nippon Aerosil Company, primary particle size: 7 nm) were added and stirred by a Henschel mixer so that the titanium dioxide and the hydrophobic silica were deposited on surfaces of the particles. Thus, a toner of Example 4 was obtained. Incidentally, the mean particle size of the toner on this occasion was 8.7 μm.

EXAMPLE 5

A toner was produced in the same manner as in Example 1 except that 83% by weight of a polyester resin (Mw=115320, Mn=4300, acid value: 4.3 mgKOH), 1% by weight of a charge control agent (trade name: T-77 made by Hodogaya Chemical Co., Ltd.), 12% by weight of ferrous metatitanate ($FeTiO_3$) and 4% by weight of Fischer-Tropsch wax (tradename: SPRAY30 made by SASOL, Mn=520 as molecular weight expressed in polyethylene, DSC heat absorption peak: 91.9° C., melting viscosity: 6.9 cp at 140° C., crystallinity: 90%) were used.

Into the particles, 1.0% by weight of titanium dioxide ($TiO_2$) (tradename: T-805 made by Nippon Aerosil Company, primary particle size: 21 nm) was added and stirred by a Henschel mixer so that the titanium dioxide was deposited on surfaces of the particles. Thus, a toner of Example 5 was obtained. Incidentally, the mean particle size of the toner on this occasion was 9.2 μm.

EXAMPLE 6

A toner was produced in the same manner as in Example 1 except that 83% by weight of a styrene-acrylic copolymer resin (tradename: Hymer SB316 made by Sanyo Chemical Industries, Ltd., Mw=238000, Mn=3500), 1% by weight of a charge control agent (trade name: T-77 made by Hodogaya Chemical Co., Ltd.), 12% by weight of ferrous metatitanate ($FeTiO_3$), 1.5% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 2.5% by weight of polyethylene wax (trade name: PW1000 made by Toyo Petrolite Co., Ltd., Mn=820 as molecular weight expressed in polyethylene, DSC heat absorption peak: 109.4° C., melting viscosity: 13.7 cp at 140° C., crystallinity: 90%) were used.

Into the particles, 0.6% by weight of titanium dioxide ($TiO_2$) (tradename: STT-60J made by Titan Kokyo Kabushiki Kaisha, primary particle size: 50 nm) and 0.3% by weight of hydrophobic silica (tradename: R976 made by Nippon Aerosil Company, primary particle size: 7 nm) were added and stirred by a Henschel mixer so that the titanium dioxide and the hydrophobic silica were deposited on surfaces of the particles. Thus, a toner of Example 6 was obtained. Incidentally, the mean particle size of the toner on this occasion was 9.4 μm.

EXAMPLE 7

A toner was produced in the same manner as in Example 1 except that 80% by weight of a polyester resin (Mw=115320, Mn=4300, acid value: 4.3 mgKOH), 1% by weight of a charge control agent (trade name: T-77 made by Hodogaya Chemical Co., Ltd.), 15% by weight of triiron-tetroxide ($Fe_3O_4$) (bulk density: 0.65, particle size: 0.18 μm, BET specific surface area: 9.7 $m^2/g$) and 4% by weight of polypropylene wax (trade name: BISCOL 660P made by Sanyo Chemical Industries, Ltd., Mn=1070 as molecular weight expressed in polyethylene, DSC heat absorption peak: 141.2° C.) were used.

Into the particles, 0.6% by weight of titanium dioxide ($TiO_2$) (tradename: T-805 made by Nippon Aerosil Company, primary particle size: 21 nm) and 0.3% by weight of hydrophobic silica (trade name: R976 made by Nippon Aerosil Company, primary particle size: 7 nm) were added and stirred by a Henschel mixer so that the titanium dioxide and the hydrophobic silica were deposited on surfaces of the particles. Thus, a toner of Example 7 was obtained. Incidentally, the mean particle size of the toner on this occasion was 8.8 μm.

EXAMPLE 8

A toner was produced in the same manner as in Example 1 except that 75% by weight of a polyester resin (Mw=115320, Mn=4300, acid value: 4.3 mgKOH), 1% by weight of a charge control agent (trade name: T-77 made by Hodogaya Chemical Co., Ltd.), 20% by weight of triiron tetroxide ($Fe_3O_4$) (bulk density: 0.65, particle size: 0.18 μm, BET specific surface area: 9.7 $m^2/g$) and 4% by weight of polyethylene wax (trade name: PW1000 made by Toyo Petrolite Co., Ltd., Mn=820 as molecular weight expressed in polyethylene, DSC heat absorption peak: 109.4° C., melting viscosity: 13.7 cp at 140° C., crystallinity: 90%) were used.

Into the particles, 1.0% by weight of titanium dioxide ($TiO_2$) (trade name: T-805 made by Nippon Aerosil Company, primary particle size: 21 nm) was added and stirred by a Henschel mixer so that the titanium dioxide was deposited on surfaces of the particles. Thus, a toner of Example 8 was obtained. Incidentally, the mean particle size of the toner on this occasion was 9.6 μm.

EXAMPLE 9

A toner was produced in the same manner as in Example 1 except that 75% by weight of a polyester resin (Mw=115320, Mn=4300, acid value: 4.3 mgKOH), 1% by weight of a charge control agent (trade name: T-77 made by Hodogaya Chemical Co., Ltd.), 20% by weight of triiron tetroxide ($Fe_3O_4$) (bulk density: 0.65, particle size: 0.18 μm, BET specific surface area: 9.7 $m^2/g$) and 4% by weight of Fischer-Tropsch wax (trade name: SPRAY30 made by SASOL, Mn=520 as molecular weight expressed in polyethylene, DSC heat absorption peak: 91.9° C., melting viscosity: 6.9 cp at 140° C., crystallinity: 90%) were used.

Into the particles, 0.5% by weight of hydrophobic silica (trade name: R976 made by Nippon Aerosil Company, primary particle size: 7 nm) were added and stirred by a Henschel mixer so that the hydrophobic silica was deposited on surfaces of the particles. Thus, a toner of Example 9 was obtained. Incidentally, the mean particle size of the toner on this occasion was 9.2 μm.

EXAMPLE 10

A toner was produced in the same manner as in Example 1 except that 75% by weight of a styrene-acrylic copolymer resin (tradename: Hymer SB316 made by Sanyo Chemical Industries, Ltd., Mw=238000, Mn=3500), 1% by weight of a charge control agent (trade name: T-77 made by Hodogaya Chemical Co., Ltd.), 20% by weight of triiron tetroxide ($Fe_3O_4$) (bulk density: 0.65, particle size: 0.18 μm, BET specific surface area: 9.7 $m^2/g$), 0.2% by weight of a blue pigment (TONER CYAN BG made by Clariant (Japan) K.K.), 1.5% by weight of paraffin wax (trade name: HNP-11 made by Nippon Seiro Co., Ltd., Mn=390 as molecular weight expressed in polyethylene, DSC heat absorption peaks: 60.9° C. and 70.6° C.) and 2.5% by weight of Fischer-Tropsch wax (trade name: SPRAY30 made by SASOL, Mn=520 as molecular weight expressed in polyethylene, DSC heat absorption peak: 91.9° C., melting viscosity: 6.9 cp at 140° C., crystallinity: 90%) were used.

Into the particles, 0.6% by weight of titanium dioxide ($TiO_2$) (trade name: T-805 made by Nippon Aerosil Company, primary particle size: 21 nm) and 0.3% byweight of hydrophobic silica (trade name: R976 made by Nippon Aerosil Company, primary particle size: 7 nm) were added and stirred by a Henschel mixer so that the titanium dioxide and the hydrophobic silica were deposited on surfaces of the particles. Thus, a toner of Example 10 was obtained. Incidentally, the mean particle size of the toner on this occasion was 8.9 μm.

EXAMPLE 11

A toner of Example 11 was obtained in the same manner as in Example 3 except that the titanium oxide (TiO) was replaced by titanium oxide ($Ti_2O_3$). Incidentally, the mean particle size of the toner on this occasion was 8.9 μm.

EXAMPLE 12

A toner of Example 12 was obtained in the same manner as in Example 3 except that the titanium oxide (TiO) was replaced by titanium oxide ($Ti_4O_7$). Incidentally, the mean particle size of the toner on this occasion was 9.2 μm.

COMPARATIVE EXAMPLE

A toner of Comparative Example was obtained in the same manner as in Example 1 except that 87% by weight of a styrene-acrylic copolymer resin (trade name: Hymer SB316 made by Sanyo Chemical Industries, Ltd., Mw=238000, Mn=3500), 1% by weight of a charge control agent (trade name: T-77 made by Hodogaya Chemical Co., Ltd.), 8% by weight of carbon black (trade name: MA-100 made by Mitsubishi Chemical Corp., particle size: 22 nm, oil absorption: 100 ml/100 g, BET specific surface area: 114 $m^2/g$) and 4% by weight of polypropylene wax (trade name:

BISCOL 660P made by Sanyo Chemical Industries, Ltd., Mn=1070 as molecular weight expressed in polyethylene, DSC heat absorption peak: 141.2° C.) were used. Incidentally, the mean particle size of the toner on this occasion-was 8.8 μm.

Next, a developing agent was produced from 3% of the toner obtained in each of Examples and Comparative Example and 97% of a magnetite carrier (having a mean particle size of 90 μm and surface-coated with silicone). Printing due to the developing agent was evaluated by the following method.

In an electrophotographic laser beam printer using OPC as a photoconductor, image formation was performed at a printing rate of 60 sheets per minute (i.e., at a printing process speed of 26.7 cm/sec) in the condition of an OPC charged potential of −650 V, a residual potential of −50 V, a developing bias potential of −400 V and a developing portion contrast potential of 350 V. The developing unit used was a center feed type developing unit having developing magnetic rolls rotating in a forward direction and developing magnetic rolls rotating in a reverse direction with respect to the direction of movement of the electrostatic charge holding member. The developing gap (the distance between the photoconductor and a developing roll sleeve) was set at 0.8 mm. An image was produced by reversal development.

The fixing unit was as follows. An aluminum core covered with a thin tube of a fluororesin (tetrafluoroethylene-perfluoroalkyl vinyl ether copolymer: PFA) (40 μm thick) and provided with a heater lamp in its center portion was used as a heat roll. An aluminum core provided with a silicone rubber layer (7 mm thick) having a rubber hardness of about 30 degrees and covered with a PFA tube as its outermost layer was used as a backup roll. The fixing condition was selected so that the process speed was 26.7 cm/sec, the outer diameter of each of the heat roll and the backup roll was 60 mm, the pressing load was 50 kgf and the width of the contact (nip) region between the heat roll and the backup roll was about 7 mm.

(1) Image Density

The image density of a solid black image 1 inch square was measured by a reflection densitometer (RD-914 made by Macbeth Co.).

(2) Print Stability

The toner obtained in each of Examples and Comparative Example was applied to the laser beam printer to perform 50000 pages' continuous printing. The image density of a solid black image 1 inch square on this occasion was measured by the reflection densitometer (RD-914 made by Macbeth Co.).

(3) Non-Offset Temperature Range

While the control temperature of the heat roll was changed, offset yield strength was evaluated on the basis of stain on a blank portion of the fixed image at each surface temperature of the heat roll. Although the heat roll was originally provided with a cleaner of the type of reeling up a roll of Nomex paper impregnated with silicone oil, the cleaner was removed when offset yield strength was evaluated. That is, an image was recorded on a thick sheet of paper (about 200 μm thick) and on a thin sheet of paper (about 100 μm thick) in a state in which silicone oil was absent. Low-temperature offset yield strength was evaluated in the former. High-temperature offset yield strength was evaluated in the latter.

(4) Fixing Strength

The surface temperature of the heat roll of the fixing unit was set at 185° C. A 1-inch square solid black image recorded on the thick sheet of paper (about 200 μm thick) and a lineal drawing at laser beam intervals of 1 ON-state every 4 OFF-states were subjected to a tape peel test and a rubbing test respectively to thereby evaluate the fixing strength of the image.

The tape peel test was carried out as follows. Scotch Mending Tape 810 was stuck onto the solid black image. Image densities before and after peeling of the tape were measured by the reflection densitometer (RD-914 made by Macbeth Co.). The tape peel strength was calculated by the following equation.

Tape Peel Strength (%)=(Reflection Density of Solid Black Image after Peeling of Tape/Reflection Density of Solid Black Image before Peeling of Tape)×100

The rubbing test was carried out as follows. The lineal drawing was rubbed with Whatman filter paper 44 under a load of 200 gf. The degree of stain on the filter paper was evaluated by a whiteness meter. The light reflectance ratio of stained filter paper to non-stained filter paper was calculated as a Hunter value (%) and used as rubbing strength (%).

FIGS. 2 and 3 are views showing contents in Examples and Comparative Example and the printing change and fixing characteristic of each toner.

In each of Examples 1 to 4 in which not carbon black but titanium oxide (TiO) was used as a coloring pigment, image density higher than 1.2 was shown. It was confirmed that each of Examples 1 to 4 was effective in visualizing a latent image sufficiently. In each of Examples 2 and 3 in which titanium dioxide ($TiO_2$) was used as an external additive, lowering of the image density after 50000 pages' printing was little observed.

Also in Example 4 in which titanium dioxide ($TiO_2$) and silica ($SiO_2$) were used in combination as external additives, lowering of the image density after 50000 pages' printing was little observed. In each of Examples 3 and 4 in which low-melting wax was used, the non-offset temperature range was enlarged on the low temperature side to thereby make it possible to increase tape peel strength and rubbing strength.

In each of Examples 5 and 6 in which not carbon black but titanium iron oxide ($FeTiO_3$) was used as a coloring pigment, image density higher than 1.2 was shown. It was confirmed that each of Examples 5 and 6 was effective in visualizing a latent image sufficiently. In Example 6 in which titanium dioxide ($TiO_2$) and silica ($SiO_2$) were used in combination as external additives, lowering of the image density after 50000 pages' printing was little observed.

Also in each of Examples 7 to 10 in which not carbon black but triiron tetroxide as magnetic iron oxide was used as a coloring pigment, image density higher than 1.0 was shown. It was confirmed that each of Examples 7 to 10 was effective in visualizing a latent image sufficiently. In Example 8 in which titanium dioxide ($TiO_2$) was used as an external additive, lowering of the image density after 50000 pages' printing was little observed.

Also in each of Examples 7 and 10 in which titanium dioxide ($TiO_2$) and silica ($SiO_2$) were used in combination as external additives, lowering of the image density after 50000 pages' printing was little observed.

In each of Examples 8 to 10 in which low-melting wax was used, the non-offset temperature range was enlarged on the low temperature side to thereby make it possible to increase tape peel strength and rubbing strength.

As shown in FIGS. 2 and 3, in the toner using a titanium compound or titanium iron oxide as a coloring pigment in the invention, colorability, fixing characteristic and stable printing equivalent to those in Comparative Example (related art) can be secured. Also in the toner using magnetic iron oxide as a colorant, high fixing characteristic and stable printing-can be secured.

The invention configured as described above can provide an electrophotographic toner having characteristic substantially equivalent to that of the related-art toner in terms of colorability, fixing characteristic, stability, etc. and paying attention to the environment and safety, and an image-forming system using the electrophotographic toner.

What is claimed is:

1. An image-forming system comprising:

an electrostatic charge holding member;

a developing portion using an electrophotographic toner for actualizing an electrostatic charge latent image formed on said electrostatic charge holding member;

a transfer portion for transferring the actualized toner image onto a recording medium;

a cleaning portion for cleaning up the toner image remaining on said electrostatic charge holding member; and a fixing portion for fixing the toner image transferred onto said recording medium, wherein said electrophotographic toner comprises:

a fixing resin; and a colorant, and wherein said electrophotographic toner comprises a black toner using a titanium oxide comprising no carbon black as said colorant.

2. The image-forming system according to claim 1, wherein said developing portion includes center feed type developing magnetic rolls which includes developing magnetic rolls rotating in a forward direction and developing magnetic rolls rotating in a backward direction with respect to a direction of movement of said electrostatic charge holding member.

3. An image-forming system comprising:

an electrostatic charge holding member;

a developing portion using an electrophotographic toner for actualizing an electrostatic charge latent image formed on said electrostatic charge holding member;

a transfer portion for transferring the actualized toner image onto a recording medium;

a cleaning portion for cleaning up the toner image remaining on said electrostatic charge holding member; and a fixing portion for fixing the toner image transferred onto said recording medium, wherein said electrophotographic toner comprises:

a fixing resin; and a colorant, and wherein said electrophotographic toner comprises an electrophotographic two-component black toner using magnetic iron oxide containing no carbon black as said colorant.

4. The image-forming system according to claim 3, wherein said developing portion includes center feed type developing magnetic rolls which includes developing magnetic rolls rotating in a forward direction and developing magnetic rolls rotating in a backward direction with respect to a direction of movement of said electrostatic charge holding member.

* * * * *